US012318658B1

(12) United States Patent
Wang et al.

(10) Patent No.: US 12,318,658 B1
(45) Date of Patent: Jun. 3, 2025

(54) AUTOMATIC CHASSIS LIFTING MECHANISM FOR TREADMILL

(71) Applicants: Wuyi Rutong Leisure Products Co., Ltd., Zhejiang (CN); Jinhua Jingke Fitness Equipment Co., Ltd, Zhejiang (CN)

(72) Inventors: Zhiyong Wang, Zhejiang (CN); Guanghuan Yu, Zhejiang (CN)

(73) Assignee: Wuyi Rutong Leisure Products Co., Ltd., Jinhua (CN)

( * ) Notice: Subject to any disclaimer, the term of this patent is extended or adjusted under 35 U.S.C. 154(b) by 0 days.

(21) Appl. No.: 18/883,536

(22) Filed: Sep. 12, 2024

(30) Foreign Application Priority Data

Feb. 7, 2024 (CN) ..... 202420287553.9

(51) Int. Cl.
*A63B 22/00* (2006.01)
*A63B 22/02* (2006.01)

(52) U.S. Cl.
CPC ..... *A63B 22/0046* (2013.01); *A63B 22/02* (2013.01); *A63B 2225/093* (2013.01); *A63B 2225/096* (2013.01)

(58) Field of Classification Search
CPC ..... A63B 22/0046; A63B 22/02; A63B 2225/093; A63B 2225/096; A63B 22/0023
See application file for complete search history.

(56) References Cited

U.S. PATENT DOCUMENTS

2003/0134717 A1* 7/2003 Wang ..... A63B 22/02 482/54
2007/0049464 A1* 3/2007 Chou ..... A63B 22/0023 482/54
2013/0237384 A1* 9/2013 Huang ..... A63B 22/02 482/54

* cited by examiner

*Primary Examiner* — Sundhara M Ganesan
*Assistant Examiner* — Jacqueline N L Loberiza

(57) ABSTRACT

The present disclosure provides an automatic chassis lifting mechanism for a treadmill, including a chassis, where an upper housing is mounted at an upper end of an upper surface of the chassis, a lower housing is mounted at a position of a lower surface of the chassis corresponding to the upper housing, a running belt is rotationally mounted at the center of the upper surface of the chassis, an automatic lifting mechanism is mounted below the lower housing, the automatic lifting mechanism is rotationally connected to the chassis, and the slope of the treadmill is adjusted by means of the automatic lifting mechanism. The automatic lifting mechanism includes an adjustable lifting frame and a push rod motor, the adjustable lifting frame is rotationally arranged at a position of the bottom of the chassis close to the lower housing.

4 Claims, 5 Drawing Sheets

AUTOMATIC CHASSIS LIFTING MECHANISM FOR TREADMILL

CROSS-REFERENCE TO RELATED APPLICATION

This application claims priority from the Chinese patent application 2024202875539 filed Feb. 7, 2024, the content of which is incorporated herein in the entirety by reference.

TECHNICAL FIELD

The present disclosure relates to the technical field of lifting structures for treadmills, in particular to an automatic chassis lifting mechanism for a treadmill.

BACKGROUND

With the development of the society and the change in the work nature of people, the daily exercise amount of people drops dramatically. In order to ensure the physical health, people usually perform a moderate amount of running exercise to enhance their physical fitness.

When people perform the running exercise outdoors, they are often affected by the weather such as rain, snow and strong winds, and thus treadmills become a preferred choice for the daily running exercise of people. In order to perform the running exercise at any time, people often purchase flat treadmills without armrests for the running exercise, such treadmills have no armrests, thereby reducing the occupied space, and such treadmills are light and convenient to move. However, the running slopes of such flat treadmills cannot be adjusted, and users cannot adjust the slopes of the treadmills according to their demands.

SUMMARY

In order to solve the technical problems in the prior art, the present disclosure provides an automatic chassis lifting mechanism for a treadmill.

The automatic chassis lifting mechanism for the treadmill provided in the present disclosure adopts the following technical solution:

the automatic chassis lifting mechanism for the treadmill comprises a chassis, where an upper housing is mounted at an upper end of an upper surface of the chassis, a lower housing is mounted at a position of a lower surface of the chassis corresponding to the upper housing, a running belt is rotationally mounted at the center of the upper surface of the chassis, an automatic lifting mechanism is mounted below the lower housing, the automatic lifting mechanism is rotationally connected to the chassis, the slope of the treadmill is adjusted by means of the automatic lifting mechanism, the automatic lifting mechanism comprises an adjustable lifting frame and a push rod motor, the adjustable lifting frame is rotationally arranged at a position of the bottom of the chassis close to the lower housing, a mounting base is fixedly arranged at an upper portion of a surface of the chassis, the push rod motor is fixedly mounted on the mounting base, the push rod motor is internally provided with a push tube, and the bottom of the push tube is rotationally connected to the adjustable lifting frame, so that the push rod motor is mounted between the upper housing and the lower housing at a certain inclination.

Further, rotating bases are mounted on an inner wall of the chassis close to the lower housing, and the adjustable lifting frame is rotationally mounted on the rotating bases, so that the adjustable lifting frame is rotationally connected to the chassis.

Further, the adjustable lifting frame comprises support plates and a connecting beam, there are two support plates arranged in a mirrored manner, the connecting beam for connecting the support plates is arranged between the two mirrored support plates, and the connecting beam is located at upper ends of the support plates; and a connecting rod for connecting the support plates is further arranged between the two mirrored support plates, and the connecting rod is located at a lower end of the connecting beam.

Further, an adapter for connecting the connecting beam and the connecting rod is arranged between the connecting beam and the connecting rod, a through mounting hole is formed in a side wall of the adapter, and a through hole is formed in a position of the bottom of the adapter corresponding to the mounting hole.

Further, the bottom of the push tube is provided with a positioning through hole, a sleeve is fixedly mounted in the positioning through hole, and a bolt or a hinge pin is mounted in a penetrating manner in the mounting hole of the adapter and in the sleeve of the push tube, so that the push rod motor is rotationally connected to the adjustable lifting frame.

Further, wheels are rotationally connected to the tops of the support plates, and the treadmill is moved conveniently by means of the wheels.

Further, connecting through holes are formed in the bottoms of the support plates, and the connecting through holes are rotationally connected to the rotating bases on the inner wall of the chassis, so that the adjustable lifting frame is rotationally connected to the chassis.

Further, second protective pads for preventing the adjustable lifting frame from rubbing against the ground are mounted at the bottom of the adjustable lifting frame, avoidance through grooves are formed in positions of the lower housing corresponding to the wheels, the wheels are arranged in the avoidance through grooves, first protective pads are mounted at positions of the chassis corresponding to the wheels, and the first protective pads are located between the chassis and the wheels, thereby preventing the wheels from rubbing against the bottom of the chassis.

In conclusion, the beneficial effects of the present disclosure are as follows:

in the present disclosure, the automatic lifting mechanism is arranged, when a user runs, by starting the push rod motor of the automatic lifting mechanism, the push rod motor drives the push tube to extend downwards, and the adjustable lifting frame rotates downwards in a side wall of the chassis under a thrust of the push tube, so as to support an upper portion of the chassis upwards, thereby adjusting the slope of the treadmill; and by means of the structure, the user can conveniently adjust the treadmill to the required slope for use.

Figure 1:
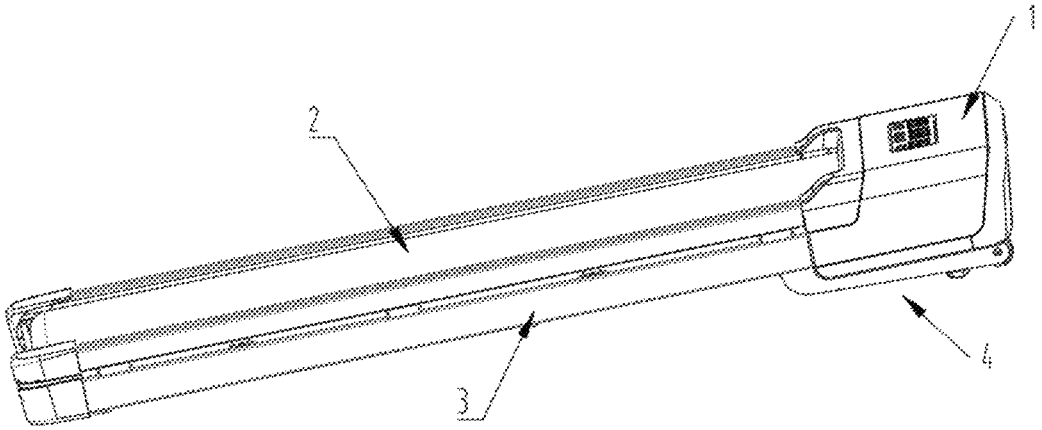
FIG. 1 is a first overall structural schematic diagram of the present disclosure.

In the drawings: 1—upper housing; 2—running belt; 3—chassis; 4—automatic lifting mechanism; 5—lower housing; 6—second protective pad; 7—wheel; 8—first protective pad; 301—mounting base; 302—rotating base; 401—adjustable lifting frame; 402—push rod motor; 4011—support plate; 4012—connecting beam; 4013—connecting rod; 4014—adapter; 4015—mounting hole; 4016—through hole; 4021—push tube; and 4022—sleeve.

DETAILED DESCRIPTION OF EMBODIMENTS

The present disclosure is further described below in conjunction with particular embodiments, and the schematic embodiments and description of the present disclosure are intended to explain the present disclosure, but are not intended to limit the present disclosure.

Embodiments: an automatic chassis lifting mechanism for a treadmill as shown in FIG. 1, FIG. 2, FIG. 3, FIG. 4, FIG. 5 and FIG. 6.

Figure 2:
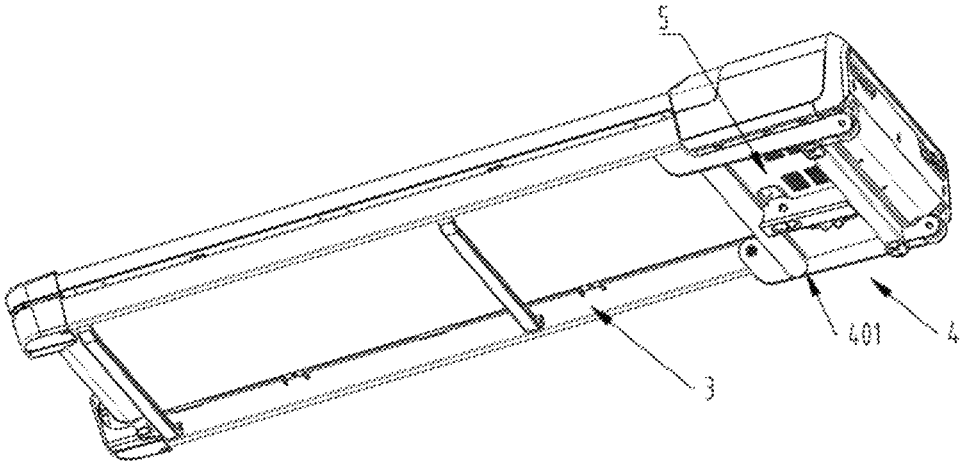
FIG. 2 is a second overall structural schematic diagram of the present disclosure.

In the first embodiment of the present disclosure, as shown in FIG. 1 and FIG. 2, the automatic chassis lifting mechanism for the treadmill includes a chassis 3, where an upper housing 1 is mounted at an upper end of an upper surface of the chassis 3, a lower housing 5 is mounted at a position of a lower surface of the chassis 3 corresponding to the upper housing 1, and a running belt 2 is rotationally mounted at the center of the upper surface of the chassis 3. An automatic lifting mechanism 4 is mounted below the lower housing 5, the automatic lifting mechanism 4 is rotationally connected to the chassis 3, and the slope of the treadmill is adjusted by means of the automatic lifting mechanism 4.

The specific structure of the automatic lifting mechanism 4 is as shown in FIG. 2-FIG. 6. The automatic lifting mechanism 4 includes an adjustable lifting frame 401 and a push rod motor 402, the adjustable lifting frame 401 is rotationally arranged at a position of the bottom of the chassis 3 close to the lower housing 5, preferably, rotating bases 302 are mounted on an inner wall of the chassis 3 close to the lower housing 5, and the adjustable lifting frame 401 is rotationally mounted on the rotating bases 302, so that the adjustable lifting frame 401 is rotationally connected to the chassis 3. A mounting base 301 is fixedly arranged at an upper portion of a surface of the chassis 3, the push rod motor 402 is fixedly mounted on the mounting base 301, the push rod motor 402 is internally provided with a push tube 4021, and the bottom of the push tube 4021 is rotationally connected to the adjustable lifting frame 401, so that the push rod motor 402 is mounted between the upper housing 1 and the lower housing 5 at a certain inclination.

Figure 3:
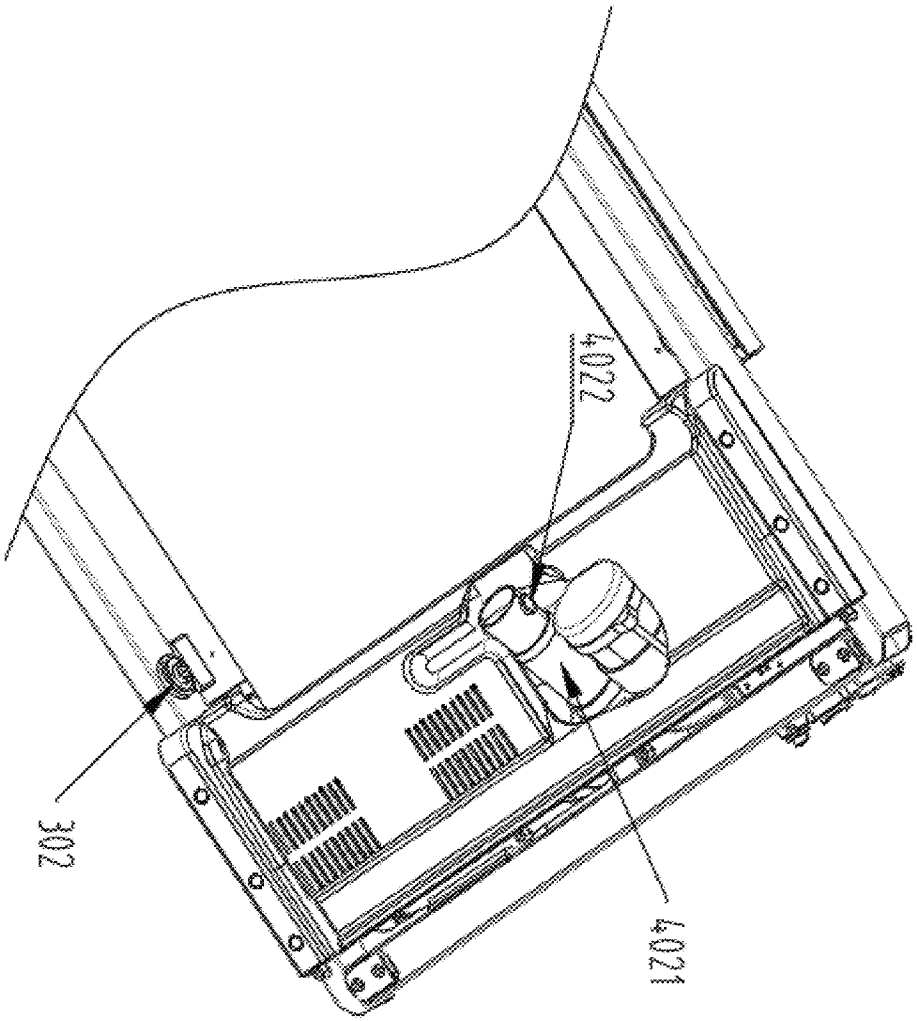
FIG. 3 is a bottom structural schematic diagram of a chassis in the present disclosure.
Figure 4:
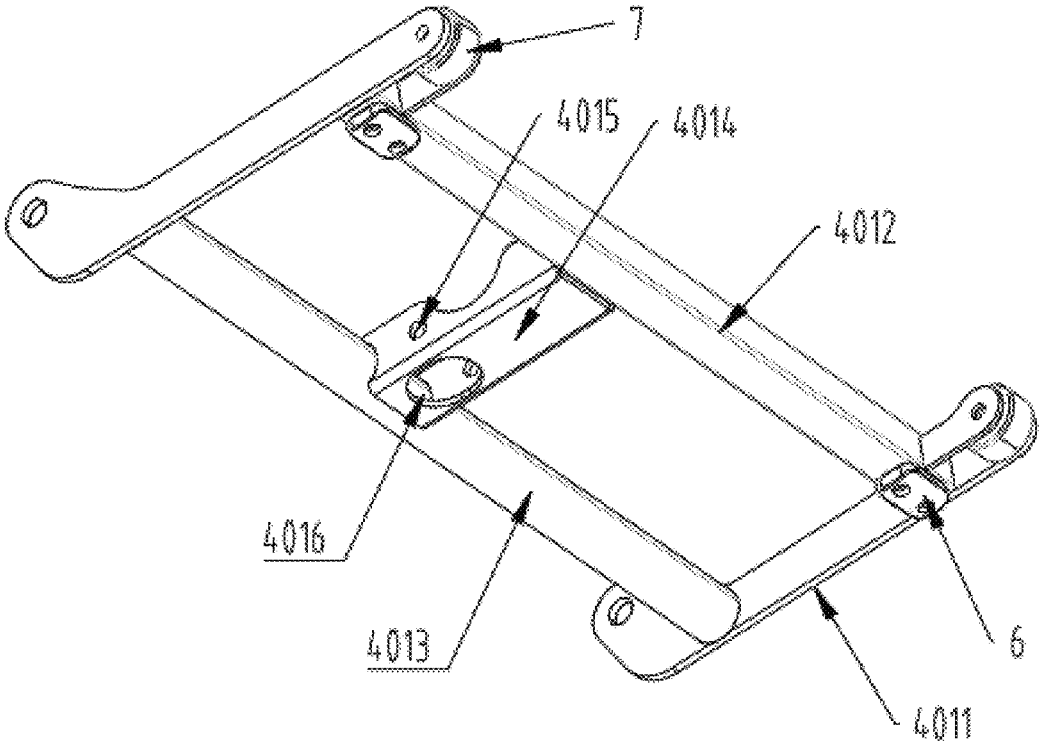
FIG. 4 is a structural schematic diagram of an adjustable lifting frame in the present disclosure.
Figure 5:
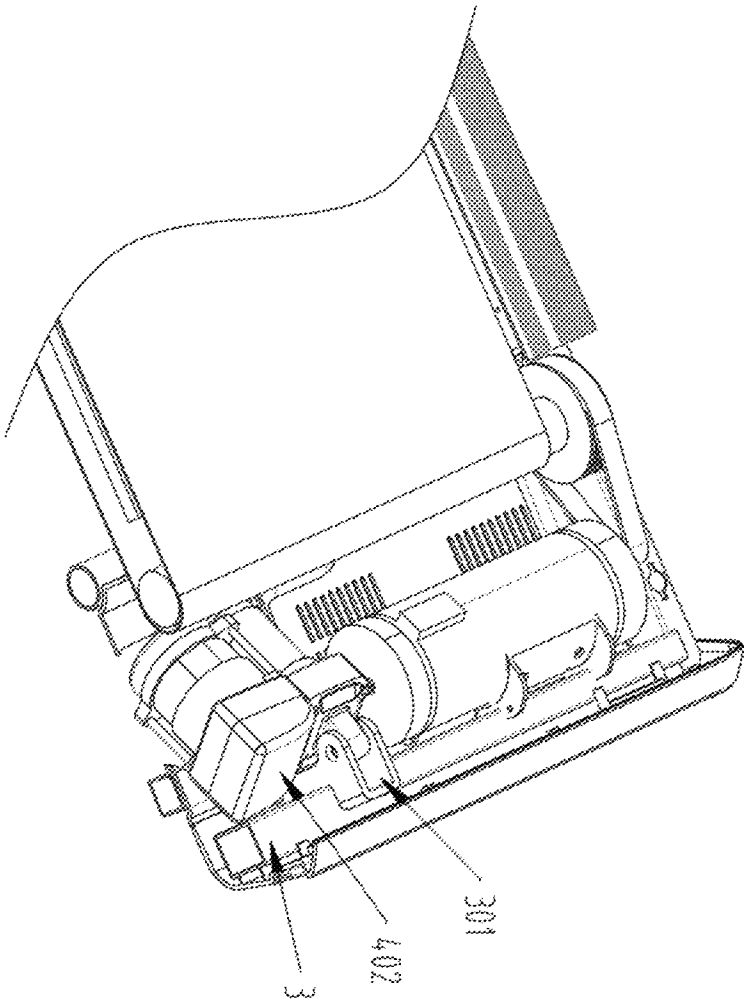
FIG. 5 is an internal structural schematic diagram of the present disclosure.

The specific structure of the adjustable lifting frame 401 is as shown in FIG. 4 and includes support plates 4011 and a connecting beam 4012, there are two support plates 4011 arranged in a mirrored manner, the connecting beam 4012 for connecting the support plates is arranged between the two mirrored support plates 4011, and the connecting beam 4012 is located at upper ends of the support plates 4011; a connecting rod 4013 for connecting the support plates is further arranged between the two mirrored support plates 4011, and the connecting rod 4013 is located at a lower end of the connecting beam 4012; an adapter 4014 for connecting the connecting beam and the connecting rod is arranged between the connecting beam 4012 and the connecting rod 4013, a through mounting hole 4015 is formed in a side wall of the adapter 4014, and a through hole 4016 is formed in a position of the bottom of the adapter 4014 corresponding to the mounting hole 4015; as shown in FIG. 3, the bottom of the push tube 4021 is provided with a positioning through hole, a sleeve 4022 is fixedly mounted in the positioning through hole, and a bolt or a hinge pin is mounted in a penetrating manner in the mounting hole 4015 of the adapter 4014 and in the sleeve 4022 of the push tube 4021, so that the push rod motor 402 is rotationally connected to the adjustable lifting frame 401. Wheels 7 are rotationally connected to the tops of the support plates 4011, and the treadmill is moved conveniently by means of the wheels 7. Connecting through holes are formed in the bottoms of the support plates 4011, and the connecting through holes are rotationally connected to the rotating bases 302 on the inner wall of the chassis 3, so that the adjustable lifting frame 401 is rotationally connected to the chassis 3.

When a user runs, by starting the push rod motor 402, the push rod motor 402 drives the push tube 4021 to extend downwards, and the adjustable lifting frame 401 rotates downwards in a side wall of the chassis 3 under a thrust of the push tube 4021, so as to support an upper portion of the chassis 3 upwards, thereby adjusting the slope of the treadmill; and by means of the structure, the user can conveniently adjust the treadmill to the required slope for use.

Figure 6:
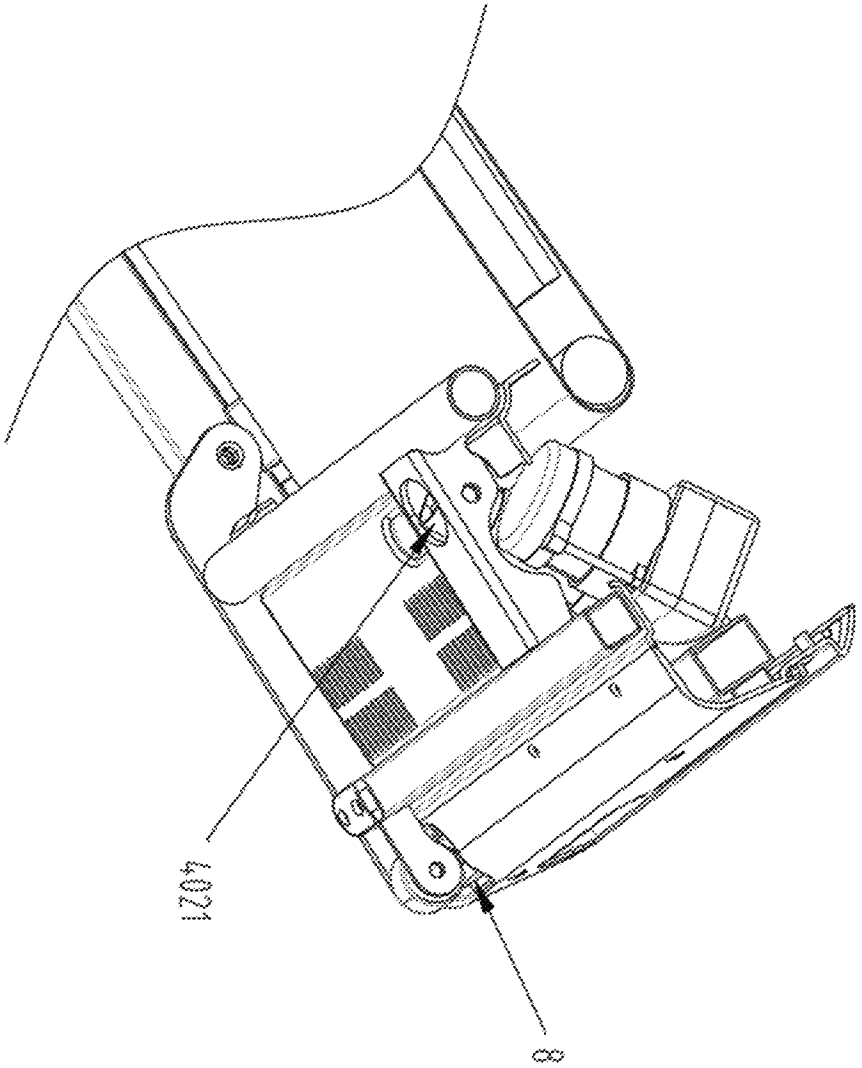
FIG. 6 is a bottom structural schematic diagram of the present disclosure.

In the second embodiment of the present disclosure, as shown in FIG. 4 and FIG. 6, second protective pads 6 for preventing the adjustable lifting frame 401 from rubbing against the ground are mounted at the bottom of the adjustable lifting frame 401, avoidance through grooves are formed in positions of the lower housing 5 corresponding to the wheels 7, the wheels 7 are arranged in the avoidance through grooves, first protective pads 8 are mounted at positions of the chassis 3 corresponding to the wheels 7, and the first protective pads 8 are located between the chassis 3 and the wheels 7, thereby preventing the wheels 7 from rubbing against the bottom of the chassis 3.

During usage, the second protective pads 6 are arranged, thus the adjustable lifting frame 401 can be effectively prevented from rubbing against the ground, and the second protective pads 6 are prevented from scratching the ground. The first protective pads 8 are arranged, and thus the problem that the wheels 7 and the bottom of the chassis 3 rub against each other and abrade each other can be effectively prevented.

The basic principles, main features and advantages of the present disclosure are shown and described above. Components mentioned in the present disclosure are common technologies in the existing field. A person skilled in the art should understand that the present disclosure is not limited by the above embodiments, the descriptions in the above embodiments and specification are only for illustrating the principles of the present disclosure, the present disclosure may be subjected to various changes and improvements without departing from the spirit and scope of the present disclosure, and these changes and improvements should fall within the scope of protection of the present disclosure. The scope of protection of the present disclosure should be subject to the claims and equivalents thereof.

What is claimed is:

1. An automatic chassis lifting mechanism for a treadmill, comprising a chassis, wherein an upper housing is mounted at an upper end of an upper surface of the chassis, a lower housing is mounted at a position of a lower surface of the chassis corresponding to the upper housing, a running belt is rotationally mounted at the center of the upper surface of the chassis, an automatic lifting mechanism is mounted below the lower housing, the automatic lifting mechanism is rotationally connected to the chassis, and the slope of the treadmill is adjusted by means of the automatic lifting mechanism;

the automatic lifting mechanism comprises an adjustable lifting frame and a push rod motor, the adjustable lifting frame is rotationally arranged at a position of the bottom of the chassis close to the lower housing, a mounting base is fixedly arranged at an upper portion of a surface of the chassis, the push rod motor is fixedly mounted on the mounting base, the push rod motor is internally provided with a push tube, and the bottom of the push tube is rotationally connected to the adjustable lifting frame, and the push rod motor is mounted between the upper housing and the lower housing;

rotating bases are mounted on an inner wall of the chassis close to the lower housing, and the adjustable lifting frame is rotationally mounted on the rotating bases, so that the adjustable lifting frame is rotationally connected to the chassis;

the adjustable lifting frame comprises support plates and a connecting beam, there are two support plates arranged in a mirrored manner, the connecting beam for connecting the support plates is arranged between the two mirrored support plates, and the connecting beam is located at upper ends of the support plates; and a connecting rod for connecting the support plates is further arranged between the two mirrored support plates, and the connecting rod is located at a lower end of the connecting beam;

an adapter for connecting the connecting beam and the connecting rod is arranged between the connecting beam and the connecting rod, a through mounting hole is formed in a side wall of the adapter, and a through hole is formed in a position of the bottom of the adapter corresponding to the mounting hole; and the bottom of the push tube is provided with a positioning through hole, a sleeve is fixedly mounted in the positioning through hole, and a bolt or a hinge pin is mounted in a penetrating manner in the mounting hole of the adapter and in the sleeve of the push tube, so that the push rod motor is rotationally connected to the adjustable lifting frame.

2. The automatic chassis lifting mechanism according to claim 1, wherein wheels are rotationally connected to the tops of the support plates, and the treadmill is moved conveniently by means of the wheels.

3. The automatic chassis lifting mechanism according to claim 1, wherein connecting through holes are formed in the bottoms of the support plates, and the connecting through holes are rotationally connected to the rotating bases on the inner wall of the chassis, so that the adjustable lifting frame is rotationally connected to the chassis.

4. The automatic chassis lifting mechanism according to claim 3, wherein second protective pads for preventing the adjustable lifting frame from rubbing against the ground are mounted at the bottom of the adjustable lifting frame, avoidance through grooves are formed in positions of the lower housing corresponding to the wheels, the wheels are arranged in the avoidance through grooves, first protective pads are mounted at positions of the chassis corresponding to the wheels, and the first protective pads are located between the chassis and the wheels, thereby preventing the wheels from rubbing against the bottom of the chassis.

* * * * *